US005368191A

United States Patent [19]

Johnson

[11] Patent Number: 5,368,191

[45] Date of Patent: Nov. 29, 1994

[54] GRAVITY FEED PRODUCT DISPLAY DISPENSER

[75] Inventor: Allen E. Johnson, Hartford, Wis.

[73] Assignee: DCI Marketing, Milwaukee, Wis.

[21] Appl. No.: 50,854

[22] Filed: Apr. 21, 1993

[51] Int. Cl.[5] ..... B65H 3/00

[52] U.S. Cl. ..... 221/194; 312/42

[58] Field of Search ..... 221/194, 191, 296, 289, 221/311, 306, 307, 255, 256, 257; 312/42, 45, 49, 72; 211/49.1

[56] References Cited

U.S. PATENT DOCUMENTS

| | | | |
|---|---|---|---|
| 1,618,178 | 2/1927 | Endoes | 312/45 |
| 1,782,597 | 11/1930 | Blackman | 312/42 |
| 1,940,909 | 12/1933 | Hermani | 312/42 |
| 2,155,191 | 4/1939 | Hylton | 312/42 |
| 2,303,344 | 12/1942 | Erne | 312/42 |
| 2,805,111 | 9/1957 | Jarnot | 312/42 |
| 3,433,545 | 3/1969 | Rainey | 312/42 |

*Primary Examiner*—Kenneth W. Noland
*Attorney, Agent, or Firm*—Michael, Best & Friedrich

[57] ABSTRACT

A gravity feed product display dispenser for holding a plurality of stacked product containers and automatically orientating each container as it reaches a withdrawal position in the dispenser, to present the top surface of the container at an optimum display angle relative to horizontal.

19 Claims, 1 Drawing Sheet

GRAVITY FEED PRODUCT DISPLAY DISPENSER

BACKGROUND OF THE INVENTION

1. Field of the Invention

The present invention relates generally to a product dispenser, and more particularly to a gravity feed product display dispenser for holding a plurality of stacked products and orienting each product when it reaches a withdrawal position, at a display angle to expose the top surface of the product.

2. Description of the Related Art

Generally, gravity feed product dispensers stack the product containers held therein vertically. When a product is desired, the consumer pulls the product container that is in the withdrawal position, i.e. at the bottom of the vertical stack, horizontally towards himself until that container is completely freed from the stack. After the product container in the withdrawal position is freed from the stack, the product container that was immediately above the freed container, i.e. the penultimate container, falls downwardly into the withdrawal position due to gravity. Likewise, the remaining product containers in the stack each fall downwardly one position.

Gravity feed product dispensers vary in how the product containers are oriented in the vertical stack and how the product container in the withdrawal position is oriented. With respect to the vertical stack, product dispensers either hold the product containers therein one atop the next with the containers disposed horizontally relative to each other or with the containers disposed vertically on edge relative to each other. Depending upon the dimensions of the product containers, it is most often the case that when product containers are disposed vertically on edge relative to each other in the vertical stack, fewer containers can be stacked in the same amount of space as when the containers are stacked horizontally relative to each other.

With respect to the orientation of the product container in the withdrawal position, generally gravity feed product dispensers orient this product container in such a way that the top surface of the container is not visible to the consumer before selecting the product. One of the disadvantages of this configuration is that only a small portion of the sides of the product container in the withdrawal position can be seen by the consumer. Any information displayed on the top surface of the product container is hidden from view from the consumer until the product container has been completely removed from the stack. Often, information on the top surface of the product containers is of value to the consumer before a purchase is made such as expiration or quality dates.

In addition, normally the product container in the withdrawal position is oriented in the same manner as the product container in the penultimate position. The disadvantage of this configuration is that in order to remove the product container in the withdrawal position, the weight of that container along with the combined weight of all of the other product containers in the stack must be overcome in order to remove just the product container in the withdrawal position.

SUMMARY OF THE INVENTION

The present invention provides a display dispenser for holding a plurality of stacked product containers and automatically orientating each container as it reaches a withdrawal position in the dispenser, to present the top surface of the container at an optimum display angle relative to horizontal. The dispenser includes a stacking means, a display stage, an intermediate holding zone, and a retainer means. The stacking means holds a plurality of stacked containers and has a bottom opening through which containers held in the stacking means can pass. The display stage is spaced below the bottom opening, has a withdrawal position, receives a container from the bottom opening and orients that container to present the top surface at an optimum display angle. The intermediate holding zone is vertically between the display stage and the bottom opening and holds a penultimate container above the display stage. The retainer means is mounted in the intermediate holding zone and retains the penultimate container in a ready to descend position for release by removal of the container in the withdrawal position from the dispenser.

It is one object of the present invention to provide a gravity feed product display dispenser that automatically orients the product container that is to be withdrawn at an angle relative to the horizontal thus presenting the top surface of the container at an optimum display angle.

It is another object of the present invention to provide a gravity feed product display dispenser capable of stacking product containers held therein vertically before their descent into the withdrawal position to utilize the stacking space of the dispenser efficiently.

It is another object of the present invention to provide a gravity feed product display dispenser that allows for ease of removal of the product containers from the dispenser.

Other objects, features and advantages of the present invention will be readily appreciated as the same becomes better understood after reading the following description taken in conjunction with the accompanying drawings.

DESCRIPTION OF THE PREFERRED EMBODIMENTS

Figure 1:
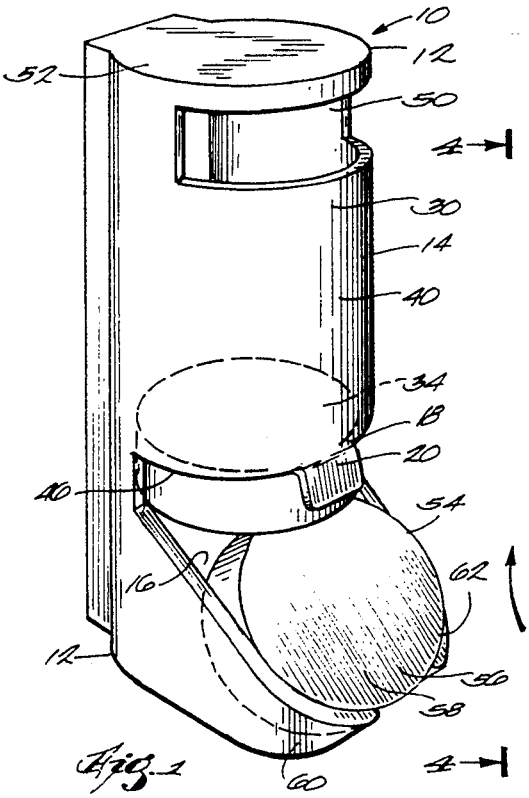
FIG. 1 is perspective view of the gravity feed product display dispenser of the present invention.
Figure 2:
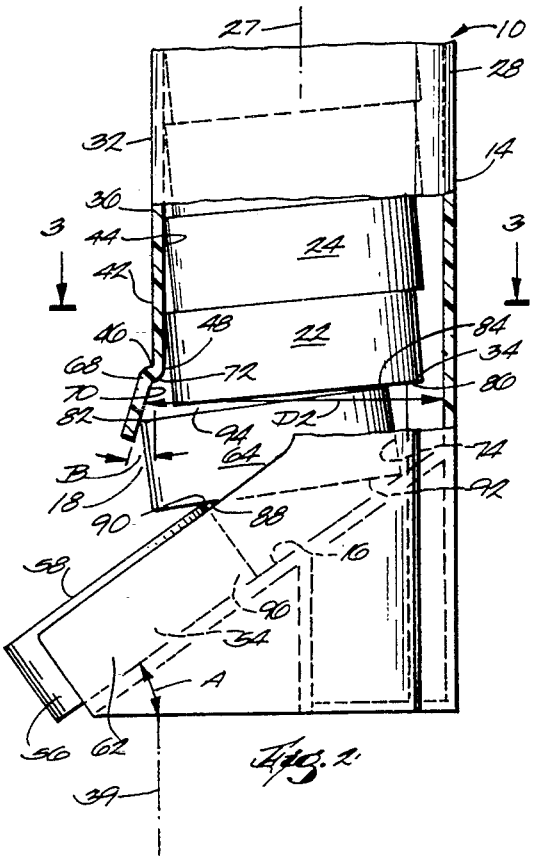
FIG. 2 is a partial side elevational view of the dispenser with portions broken away and shown in section.

Referring to FIG. 1, a display dispenser 10 generally comprises a housing 12 having stacking means 14, a display stage 16, an intermediate holding zone 18 and retainer means 20. More particularly, as seen in FIG. 2, the stacking means 14 holds a plurality of product containers 22, 24, 26 that are vertically stacked and approximately horizontally disposed relative to each other along a vertical axis 27. In all of the drawings, the product containers depicted are cylindrical. However, it should be appreciated that the product containers could be of almost any shape and dimension. It should also be appreciated that the stacking means 14 may be any type of structure such as a wire cage that can hold the product containers in the vertically stacked and horizontally disposed position relative to each other along a vertical axis. Further, the stacking means 14 can be adapted to hold any number of product containers not just the three product containers 22, 24, 26 that are depicted in FIG. 2.

Figure 3:
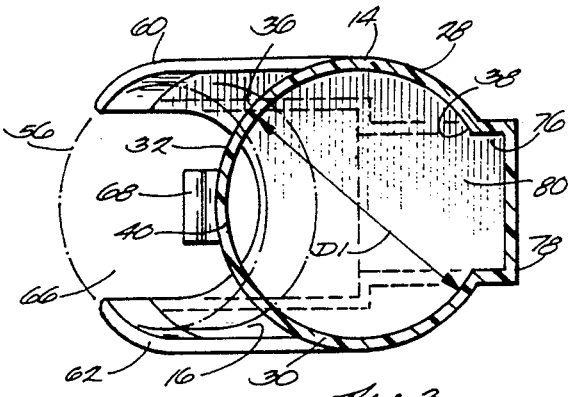
FIG. 3 is a top sectional view of the dispenser taken along line 3—3 of FIG. 2.

In the preferred embodiment as depicted in FIGS. 2 and 3, the stacking means 14 is a hollow cylinder 28 having an annular wall 30 with an inside diameter or first dimension D1 that is slightly larger than the widest outside diameter of the product containers that are to be stacked therein. The cylinder 28 has therein a forward side 32 and a bottom opening 34. The bottom opening 34 enables product containers held in the cylinder 28 to exit the cylinder 28. The cylinder 28 further includes restraint means, such as the annular wall 30, for holding the stacked product containers 22, 24, and 26 in the above-described position. The annular wall 30 has a front wall portion 36 and a rear wall portion 38. The front wall portion 36 has a center portion 40, outer and inner surfaces 42, 44 respectively, and outer and inner lower terminal margins 46, 48 respectively. The distance between the spaced front wall portion 36 and the rear wall portion 38 defines the first dimension D1.

The cylinder 28 can either be permanently enclosed thus not allowing for the restocking of additional product containers or can have an opening to allow for restocking the dispenser with product containers to replace those that have been removed. If the restocking of product containers is desired, this opening can either be, as shown in FIG. 1, an opening 50 in the upper side of the cylinder 28 such as in the forward side 32 or an opening 52 in the top of the cylinder 28.

Referring again to FIGS. 2 and 3, the display stage 16 of the dispenser is spaced below the bottom opening 34 and projects forward of a plane 39 extending downward from the forward side 32 of the cylinder 28. The display stage 16 has a withdrawal position 54 below the forward side 32 of the cylinder 28 for receiving and holding a product container 56 in the withdrawal position 54 at an acute angle A relative to the horizontal. The angle A of the withdrawal position 54 allows for the presentation of the top surface 58 of the product container 56 at an optimum display angle for viewing by the customer. In the preferred embodiment, the angle A of the display stage is in the range of 25 to 45 degrees with 35 degrees optimal for cylindrical product containers.

Figure 4:
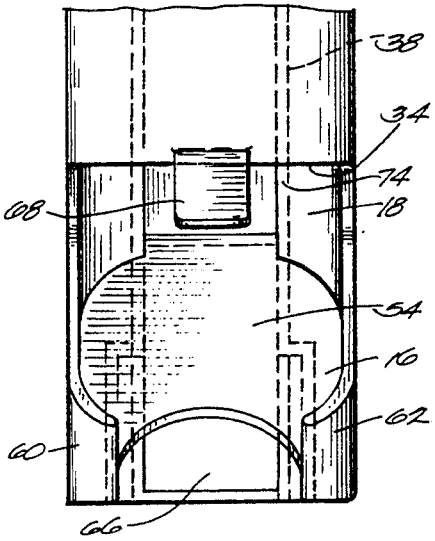
FIG. 4 is a partial front view of the dispenser taken along line 4—4 of FIG. 2.

As best shown in FIGS. 3 and 4, the display stage 16 has sidewalls 60, 62 to hold the product container 56 (shown in phantom in FIG. 3) in the withdrawal position 54 and to guide a penultimate product container 64 (shown in FIG. 2) when it descends from the intermediate holding zone 18. The sidewalls 60, 62 are spaced apart and have a relieved area 66 therebetween that is semi-circular to provide the consumer with access to grip the top and bottom surfaces of the product container 56 in the withdrawal position 54 for removal.

Referring to FIGS. 2 and 4, the intermediate holding zone 18 of the dispenser 10 is located vertically between the display stage 16 and the bottom opening 34 of the cylinder 28 for holding a penultimate product container 64 above the display stage 16. The penultimate container 64 is positioned in a canted position ready for descending from the intermediate holding zone 18 into the display stage 16. A retainer means 20, such as the tab member or salient 68 in the preferred embodiment, holds the penultimate container 64 in this position. The tab 68 is mounted in the intermediate holding zone 18 and has an interior retaining surface 70 which contacts the upper front peripheral edge 82 of the penultimate container 64 to hold it in the canted position so that when the product container 56 in the withdrawal position 54 is removed, the penultimate container 64 is released to descend onto the display stage 16. The tab 68 extends in a cantilever position at an acute angle B relative to the vertical axis 27 of the cylinder 28 and depends downward from the outer surface 42 of the center portion 40. In the preferred embodiment, the tab 68 depends downwardly from the outer terminal margin 46 of the front wall portion 36, and is offset forwardly from the outer surface 42 a distance equal to the predetermined thickness of the front wall portion 36. The acute angle B of the tab 68 relative to the vertical axis is in the range of 15 to 25 degrees, with 19 degrees being optimal. Further, in the preferred embodiment, the inner terminal margin 48 comprises a beveled edge 72 to allow for smoother movement of the product container 22 immediately above the penultimate container 64 from that position to the penultimate product container position which rests against the interior retaining surface 70 of the tab 68.

Referring to FIGS. 3 and 4, the intermediate holding zone 18 as well as the annular wall 30 of the cylinder 28 have rear wall portions 74, 38 respectively which have therein a recessed area 76. The recessed area 76 of the rear wall portions 74, 38 is continuous and defines a U-shaped channel 78 in cross section with the open portion 80 of the channel 78 facing toward the forward side 32 of the cylinder 28. The recessed area 76 can be utilized in mounting the dispenser 10 onto a vertical surface such as a wall.

As shown in FIG. 2, the intermediate holding zone 18 has a second dimension D2 defined as the distance between the rear wall portion 74 and the interior retaining surface 70 of the tab 68. This second dimension D2 is greater than the first dimension D1 of the cylinder 28 thus permitting a product container 64 in the intermediate handling zone to assume the ready to descend canted position relative to horizontal.

With reference to FIG. 2, the positioning of the product containers in the display dispenser is as follows. The product container 56 in the withdrawal position 54 is located on the display stage 16 at an angle A that enables the display of the top surface 58 of the container 56. The container 56 is held in place by the display stage sidewalls 60, 62. The penultimate product container 64 is positioned in the intermediate holding zone 18 and has four contact points: a top front peripheral edge portion 82 of the penultimate product container 64 rests against the interior restraining surface 70 of the tab 68; a rear portion 84 of the top surface of container 64 supports the lower surface 86 of the product container 22 immediate above it; a front portion 88 of the bottom surface of container 22 rests against the top peripheral rear edge 90 of the product container 56 in the withdrawal position 54; and a rear bottom peripheral edge 92 rests against the display stage 16. In this orientation, the penultimate product container 64 is in a canted position ready to descend onto the display stage 16. Also, in that orientation, there is a gap 94 between the penultimate product container 64 and the product container 22 immediately above it to enable withdrawal of the product container 56 from the withdrawal position 54 with a minimum of effort for the consumer as will be further explained. The remaining product containers 22, 24, 26 in the dispenser 10 are each canted slightly and rest upon the product container immediately below them.

The operation of the display dispenser 10 occurs as follows with reference to FIGS. 2 and 4. A consumer, desiring a product container from the dispenser, grips the product container 56 that is in the withdrawal position 54 on the display stage 16 by placing his fingers on the product container 56 between the spaced sidewalls 60, 62 and in the relieved area 66 of the display stage 16. The consumer then pulls the product container 56 towards himself while gently lifting the product container 56 upwards in order to clear the display stage sidewalls 60, 62 to free the product container 56 from the dispenser 10. Because of the gap 94 between the penultimate product container 64 and the product container 22 immediately above it, the consumer removing the product container 56 in the withdrawal position 54 will have to exert less effort and have an easier time in removing it. As the product container 56 in the withdrawal position 54 is being lifted, its lower rear peripheral edge 96 pivots about a fulcrum point on display stage 16 which raises the rear top peripheral edge 90 thereof upward slightly causing the penultimate product container 64 to also move upward slightly. The gap 94 provides an unobstructed area into which the penultimate product container 64 can be easily moved. As the product container 56 in the withdrawal position 54 is removed, the penultimate product container 64 is freed from the tab 68 and descends due to gravity onto the display stage 16 sliding forward until it rests against the display stage sidewalls 60, 62. The product container 22 that had been above the penultimate container 64 simultaneously moves into the intermediate holding zone 18 and is held in place by the tab 68 and by the product container 64 which has taken the place of product container 56 previously in the withdrawal position 54. The remaining product containers 22, 24, 26 descend downward in the stack.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A display dispenser for holding a plurality of vertically stacked horizontally disposed product containers and automatically orientating each container as it reaches a withdrawal position in the dispenser, to present a top surface of the container at an optimum display angle relative to horizontal comprising:

stacking means having a forward side, restraint means for holding a plurality of stacked containers that are horizontally disposed and vertically aligned relative to each other along a vertical axis having a front wall portion having an outer surface, and a bottom opening through which containers held in said stacking means can pass;

a display stage spaced below said bottom opening having a withdrawal position for receiving and holding a container at an angle relative to horizontal that will present a top surface of the container at an optimum display angle below said forward side;

an intermediate holding zone between said display stage and said bottom opening for holding a penultimate container above said display stage; and retainer means mounted in said intermediate holding zone positioning the penultimate container that has descended through said bottom opening at a ready position for descending to said display stage when released by removal of the container in said withdrawal position, said retainer means depends downward from said outer surface of said restraint means.

2. The display dispenser according to claim 1 wherein said restraint means includes a front wall portion having a center portion and wherein said retainer means depends downward from said center portion below said bottom opening into said intermediate holding zone.

3. The display dispenser according to claim 1 wherein said retainer means comprises a tab member extending cantilever from said front wall portion of the restraint means.

4. The display dispenser according to claim 1 wherein said restraint means includes a front wall portion having outer and inner surfaces, and outer and inner lower terminal margins, said retainer depending from said outer lower terminal margin of said front wall portion and said inner lower terminal margin comprising a beveled edge.

5. The display dispenser according to claim 1 wherein said front wall portion has a predetermined thickness and said retainer is offset forwardly from said outer surface a distance equal to said predetermined thickness.

6. The display dispenser according to claim 1 wherein said retainer means comprises a salient having an acute salient angle with respect to said vertical axis.

7. The display dispenser according to claim 6 wherein said salient angle is within a range of 15° to 25°.

8. The display dispenser according to claim 1 wherein said display stage projects forward of a vertical plane extending downward from said stacking means forward side, and said display stage holding means is oriented at an acute angle relative to horizontal.

9. The display dispenser according to claim 1 wherein said restraint means has front and rear wall portions spaced apart a first dimension and said intermediate holding zone has a front to rear second dimension that is greater than said first dimension to permit a container in said intermediate handling zone to assume a ready to descend canted position relative to horizontal when in said intermediate holding zone.

10. The display dispenser according to claim 1 wherein said display stage includes an open relieved area to permit gripping of a container on said display stage.

11. A display dispenser according to claim 1 wherein said restraint means and said intermediate holding zone each include a rear wall portion having a recessed area therein.

12. A display dispenser according to claim 11 wherein said rear wall portion comprises a channel member of U-shaped cross section with the open portion of said channel facing toward said forward side of the retaining means.

13. A display dispenser for holding a plurality of stacked product containers and automatically orientating each container as it reaches a withdrawal position in the dispenser, to present the top surface of the container at an optimum display angle relative to horizontal comprising:

a stacking means for holding a plurality of stacked containers having a front wall portion having an outer surface and having a bottom opening through which containers held in said stacking means can pass;

a display stage spaced below said bottom opening and having a withdrawal position fir receiving a container from said bottom opening and then holding the container to present the top surface thereof at an optimum display angle;

an intermediate holding zone between said display stage and said bottom opening for holding a penultimate container above said display stage; and a retainer means mounted in said intermediate holding zone for retaining the penultimate container therein at a ready to descend position for release by removal of a container from said withdrawal position, said retainer means depends downward from said outer surface of said stacking means.

14. The display dispenser according to claim 13 wherein said retainer means depends downward from said stacking means to retain a penultimate container in a canted ready to descend position.

15. The display dispenser according to claim 13 wherein said stacking means has front and rear wall portions spaced apart at a first front to rear dimension;

said retainer means depends downward from said front wall portion into said intermediate holding zone and has an interior retaining surface and;

said intermediate handling zone has a rear wall portion and second front to rear second dimension between said interior retaining surface and rear wall portion that is greater than said first dimension to permit a container passing into said intermediate holding zone to assume a canted ready to descend position relative to horizontal.

16. The display dispenser according to claim 15 wherein said retainer comprises a tab member extending cantilever from said front wall portion.

17. The display dispenser according to claim 13 wherein said stacking means has a vertical axis and said retainer means comprises a salient extending into said intermediate holding zone at an acute salient angle with respect to said axis.

18. The display dispenser according to claim 17 wherein said salient angle is within a range of 15° to 25°.

19. A display dispenser for holding product containers and automatically orientating each container before it reaches a withdrawal position to present the top surface of the container at an optimum display angle relative to horizontal comprising:

a stacking means for holding containers having a front wall portion having an outer surface and having an intermediate holding zone for holding the last container in said stacking means;

a display stage spaced below said intermediate holding zone having a withdrawal position for holding a container to be next withdrawn to present the top surface thereof at an optimum display angle; and a retainer means mounted in said intermediate holding zone for retaining the last container in said stacking means in a ready to descend onto the display stage position which will descend upon removal of the container in the withdrawal position, said retainer means depends downward from said outer surface of said stacking means.

* * * * *